United States Patent [19]

Czenthe

[11] 4,429,507

[45] Feb. 7, 1984

[54] UNIVERSAL BUILDING FRAME

[75] Inventor: Zoltan Czenthe, Budapest, Hungary

[73] Assignee: Csongrád Megyei Tanásci Épitoipari Vállalat, Hódmezövásärhely, Hungary

[21] Appl. No.: 232,401

[22] Filed: Feb. 2, 1981

Related U.S. Application Data

[63] Continuation of Ser. No. 90,109, Nov. 1, 1979, which is a continuation of Ser. No. 944,795, Sep. 22, 1978, abandoned.

[51] Int. Cl.[3] ..... E04H 12/00

[52] U.S. Cl. ..... 52/650; 52/90; 52/643; 52/641

[58] Field of Search ..... 52/650, 651, 648, 641, 52/643, 639, 730, 732, 90

[56] References Cited

U.S. PATENT DOCUMENTS

| | | | |
|---|---|---|---|
| 1,103,430 | 7/1914 | Randolph | 52/650 |
| 1,369,340 | 2/1921 | Hutchinson | 52/692 |
| 1,502,227 | 7/1924 | Arnstein | 52/732 |
| 1,634,127 | 6/1927 | Wagner | 52/690 |
| 1,818,418 | 8/1931 | Millard | 52/732 |
| 1,850,118 | 3/1932 | Meyers | 52/732 |
| 2,114,902 | 4/1938 | Henderson | 52/692 |
| 2,284,898 | 6/1942 | Hartman | 52/650 |
| 2,746,780 | 5/1956 | Comino | 52/690 |
| 3,084,479 | 4/1963 | Struben | 52/73 |
| 3,094,197 | 6/1963 | Attwood | 52/633 |

FOREIGN PATENT DOCUMENTS

| | | | |
|---|---|---|---|
| 164605 | 8/1955 | Australia | 52/633 |
| 222319 | 12/1961 | Australia | 52/633 |
| 529684 | 7/1954 | Belgium | 52/633 |
| 1297871 | 5/1962 | France | 52/633 |
| 584676 | 11/1958 | Italy | 52/633 |
| 173177 | 11/1960 | Sweden | 52/633 |

*Primary Examiner*—Henry E. Raduazo
*Attorney, Agent, or Firm*—Gabriel P. Katona

[57] ABSTRACT

The invention concerns a light-structure building and a supporting frame system therefor, which can be used equally for flat or slightly inclined roofs and is built up of a single C-section support or multiples of such support. Both the supports and their supporting elements are provided with rows of holes and thus work on site consists only of making bolted connections.

The beam network of the building is constituted by main supports and auxiliary supports disposed along an orthogonal network the members of which are C-section solid supports or built-up supports obtained by doubling the solid supports in a side-by-side relationship or single-chord Vierendeel girders formed by doubling the solid supports in a superposed relationship or in given cases, divided chord Vierendeel type girders obtained by combining the latter.

11 Claims, 7 Drawing Figures

UNIVERSAL BUILDING FRAME

This is a continuation of application Ser. No. 90,109 filed on Nov. 1, 1979, which is a continuation of Ser. No. 944,795, Sept. 22, 1978, now abandoned.

BACKGROUND OF THE INVENTION

1. Field of the Invention

The invention concerns a universal building frame principally for the load-bearing support systems of single-storey buildings of light structure, wherein the framework of the building is constituted by the combination of vertical columns and essentially horizontal beams with or without overhangs, connected to the columns and in given cases also supplementary columns, the members of the supporting system being assembled into a framework for a building on site by means of bolts of expediently identical diameter, the elements of the framework being co-ordinated as to dimension at least in the sense of the ground plan and being expediently fitted to a network based on a single basic module ($\bar{m}$), the longitudinal dimensions of the supporting elements being integral multiples of the basic dimension of this modular network, while the loci of holes for the bolt connections are integral multiples of a micro-module ($\bar{m}\bar{m}$), derived from this modular dimension, the lower order supporting elements of the supporting system being supported on each other and/or on higher order supporting elements directly or via a connecting element, while the framework of the building is completed by a load-bearing roof plate.

2. Description of the Prior Art

Efforts to eliminate the seasonal nature of the building industry and building activity have in recent decades led to the development of so-called industrialised building methods. The essence of these methods is that in a purpose-built factory, under industrial conditions, the elements of the building are prefabricated to the greatest extent possible at high accuracy and productivity. In this way, the amount of work to be done on site can be minimised and in practice such work consists merely of assembling the fully finished elements by various erection methods.

Within this "assembled" building method, which can with justification be called industrialised, one can distinguish between a so-called heavy structure and light-structure system, as well as a system between those two, the so-called "facilitated" building system. Most of the building systems of the light-structure type are of the frame building construction which means that the load-bearing system is constituted by a metallic structure, generally of steel.

Metallic structures have relatively low own weight relative to their load-bearing capacity but this very favourable property is in many cases negated by the fact that specific investment costs significantly exceed those of concrete buildings. In addition, numerous anti-corrosion and fire-protective measures must also be carried out with such structures. For the listed reasons, the employment of light-structure metallic frame buildings can in many cases only be justified by the relative shortness of building time and the minimal labour requirement on site.

It is fundamental requirement of metallic light-structure building frames that they should be capable of being assembled from a small number of elements which should be identical as far as possible on the other hand they should be readily connectible together. The classifiability of frame systems and the industrialised nature of building methods both require that these connections should be capable of being formed in a unitary manner.

Hitherto known metallic structures for building frames have not enabled the number of profiles to be reduced nor have they enabled connections to be made in a unitary (identical) manner. In building systems throughout the world several different support types are used as elements of the frame structures. Naturally, as a consequence of this the junctions of individual support types with each other and with other support types necessitate the employment of a number of connection constructions of differing characteristics. Because of the differing locations for the junctions even in the frame systems themselves the highly desired unification could not be achieved.

With partial unification that has been achieved so far only one or two requirements made for building structures of different types have been satisfied and thus so-called "purpose-built" structures have been developed. This means that such structures cannot meet all demands for a building with an intended use or purpose differing from the original design.

SUMMARY OF THE PRESENT INVENTION

The present invention aims to provide a unitary building structure which can provide the complete frame structure of single-storey buildings or that of the top floor of multi-storey buildings to be built with a light-structure method, primarily for communal use.

An additional aim of the invention is to enable so-called assembled or prefabricated buildings to be provided in a universal structural system from simple, readily producible, erectable and exchangeably precise elements with unitary connecting constructions. The aim furthermore includes the requirement that both the constructional elements and the connections should be formed on the basis of a single modular dimension and thus the whole of the construction should become dimensionally co-ordinated while erection on site should require minimal labour.

The basis of the inventive concept is the discovery that a unitary structural construction can only satisfy the varied demands arising from the functions of the buildings if the structure is based on such a basic support type which on continuously or periodically multiplying a basic unit can satisfy the various requirements as to support span and load-bearing both as regards statics and stability.

It is also a part of the discovery that an increase in load-bearing capacity by multiplying the basic section on an "additive" principle can most simply and expediently be carried out by means of cold-shaped steel sections of C-shaped cross section, or less frequently of U-shaped cross-section. Such a section employed by itself can be transformed into a divided section (built-up) support with another similar section placed next to it; while with a similar section placed above it, or below it, it can form a Vierendeel girder of single chord, or in given cases by doubling the divided section supports one below the other, one can obtain Vierendeel type girders of divided chord. This is because the use of identical basic sections also enables the method of connection to be the same throughout.

In accordance with the aims set out above, the universal building frame according to the invention is principally for the load-bearing support system of single-storey buildings of light structure, wherein the framework of the building is constituted by the combination of vertical columns including column elements and essentially horizontal assembly of beam elements or beams with or without overhangs connected to the columns and in given cases also supplementary columns, the members of the supporting system being assembled into a framework for a building on site by means of bolts of expediently identical diameter, the elements of the framework being co-ordinated as to dimension at least in the sense of the ground plan and being expediently fitted to a network based on a single basic module ($\bar{m}$), the longitudinal dimensions of the supporting elements being integral multiples of the basic dimensions of this modular network, while the loci of holes for the bolt connections are integral multiples of a micro-module ($\bar{m}\bar{m}$) derived from this modular dimension, the lower order supporting elements of the supporting system being supported on each other and/or higher order supporting elements directly or via a connecting element, while the framework of the building is completed by a load-bearing roof plate, wherein the horizontal assembly of beam elements or beams supporting the horizontal or slightly curved roof plate of the building are disposed in the same or mutually parallel horizontal planes along an orthogonal network in ground plan and consisting of main beams or supports and auxiliary beams or supports wherein:

the members of the beam network or beam elements channel-shaped in transverse cross section are: solid supports of C-shaped or U-shaped cross-section, doubled C- or U-section divided section (built-up) supports formed by doubling the first-mentioned solid supports, single chord Vierendeel type girders formed by doubling the first-mentioned solid supports one below the other and, in given cases, divided chord Vierendeel type girders obtained by a combination of the latter;

the main supports or beams including two beam elements being rigidly or pivotally connected to the columns, the auxiliary supports being expediently continuous girders while the main supports are either simply supported or continuous girders at two or more places and are expediently interrupted by internal pivots of such a number as to render them statically determinate, both the main supports and the auxiliary supports being optionally provided with overhangs;

the solid supports of C- or U-shaped cross-section, the divided section supports, the single-chord Vierendeel girders and the divided chord Vierendeel girders as well as the splices for co-ordinating the chords of the Vierendeel girders being perforated with a row of holes of a configuration matching the basic module selected in the interests of full prefabricatability, precision and in given cases, of the ability to form curved or inclined roofs.

A preferred feature of the building structure lies in that the columns are clamped to the basic bodies in both principal directions of the ground plan, or they may be pivotally connected to them in both principal directions or clamped in one principal direction while pivotally connected in the other principal direction, the trunk of the columns being an I-section, for instance, of wide feet, expediently a closed tube of that shape which may, for instance, be formed by C- or U-section pairs turned with their open faces towards each other.

In the case where the support span is small, the auxiliary supports are solid C- or U-shaped supports while in the case of large span they are single chord Vierendeel girders. In the case of small span, the main supports are C- or U-shaped built-up supports, while in the case of large span they are divided chord Vierendeel girders, the splice plates of which are expediently made up of closed sections made from C- or U-shaped members turned with their open faces towards each other.

The auxiliary supports are connected to the main supports by means of channel-shaped elements or diaphragms of expediently C- or U-shaped cross-section. Where the main supports are formed as double chord Vierendeel girders, the heads of the columns are formed as the splice plates of the Vierendeel supports, expediently in the form of C- or U-sections and perforated with a row of holes.

The longitudinal dimensions of the web g, foot t and flanges or edges p of the C-profile forming the basic section of the solid supports, the built-up supports, the single-chord Vierendeel girders and the divided chord Vierendeel girders are expediently integral multiples of the micro-module ($\bar{m}\bar{m}$). The longitudinal dimensions of the web g, feet t and flanges p of the C-shaped sections forming the solid supports, the built-up supports and the chords of the Vierendeel type girders are related to each other in a predetermined manner.

The distances ($e_x$, $e_y$) of the individual holes in the row of holes provided for the connecting elements are integral multiples of the micro-module ($\bar{m}\bar{m}$) both in the longitudinal direction (x) of the C-section as well as in a direction (y) perpendicular to that. In the direction (y) at right angles to the longitudinal axis (x) of the horizontal C-sections, the minimum hole spacing (y°) is one-half of the smallest hole spacing ($e_x$) in the longitudinal direction (x). The horizontal C-profiles are expediently divided along the bisection lines of the hole spacing ($e_x$) in the longitudinal direction (x) and thereby the lengths of the C-profiles themselves become integral multiples of the micro-module ($\bar{m}\bar{m}$) and thus also of the basic module ($\bar{m}$).

The holes in the diaphragms both in the web g, and the foot t are disposed at a distance of at least one micro-module ($\bar{m}\bar{m}$) from the line of intersection of external planes of the web g and the foot t.

The dimensions and construction of the C-profiles formed as a single-chord Vierendeel girder and constituting the chords of the auxiliary supports of large span agree with those of the C-profiles formed as solid supports and constituting the small span auxiliary supports. The dimensions and construction of the C-profiles formed as divided-section Vierendeel girders and constituting the chords of the large-span main supports agree with those of the C-profiles formed as divided-section supports and constituting main supports of small span.

In an expedient embodiment of the light-structure building frame according to the invention, when the roof is not horizontal the disposition of the main supports and auxiliary supports remains the same as in the case of a horizontal roof while the inclination of the roof is imparted by diaphragms of varying heights.

The universal building frame according to the invention has numerous advantages. Most of these arise from the selection of the support type, i.e. from the circumstance that by doubling the basic section in a side-by-side or superposed arrangement, or in given cases by quadrupling it, a single basic element enables a complete building frame to be assembled for even the most varied functional requirements while affording all the load-bearing capacity likely to be encountered in practice.

The building frame can equally be used in the case of level or slightly sloping roofs. The possibility also arises of constructing a structure suitable for roof skylighting. In that case in at least every second field the roof plane can be suspended below the lower chord of the Vierendeel type main girders.

It is also advantageous that every part of the building frame, even those which are formed as Vierendeel type girders, can be erected on site from basic elements forming the basic section. Naturally, the possibility also arises of pre-erecting frameworks from columns and main supports connected thereto and lifting the whole assembly to its place in one. In addition, one can also employ high productivity erection technology such as the "lift-slab" process.

One can also mention as being one of the favourable properties of the universal building frame according to the invention that it is simple to transport it. This manifests itself in that even the divided chord Vierendeel type main girder of the largest span can, if required, be transported to site in sections. The assembly is considerably facilitated by the fact that both the supports and their connecting elements are provided with a series of holes and thus the work on site consists merely in assembling the ready-made elements and from locating and tightening the bolts.

BRIEF DESCRIPTION OF THE DRAWING

The invention is described in greater detail by way of a preferred embodiment shown in the accompanying schematic drawings, wherein.

DESCRIPTION OF THE PREFERRED EMBODIMENTS

Figure 1:
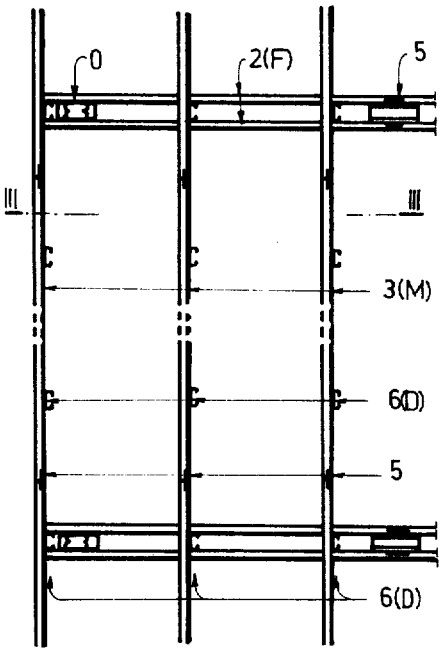
FIG. 1 is a ground-plan of the building frame in the case of main supports of small span.

In the case of the embodiment of FIG. 1, the beam assembly built up from horizontal supports is constituted by main supports F and auxiliary supports M. The main supports of small span are formed as divided-section (built-up) supports of double-C-section denoted by the reference number 2. The divided section supports 2 are made up of two solid supports 1 of C-shaped cross-section which are identical and which are turned towards each other with their webs.

The auxiliary supports M also consist of two identical C-shaped solid supports 1 but these are superposed on each other and thus together constitute single chord Vierendeel girders 3. The doubling of the solid supports 1 serving as a basic section is necessitated by the large span of the auxiliary supports M. Auxiliary supports M of small span can be formed from single solid supports 1 of C-shaped cross-section also.

The chords of the single chord Vierendeel girders 3 forming the auxiliary supports M are connected by splice plates 6 at various locations and these latter are also expediently of C-shaped cross-section and form the columns of the single-chord Vierendeel girders 3. The main supports F are connected to columns 0 in such a manner that in plan view the built-up supports 2 forming the main supports F sandwich the column 0 between their "half-sections".

The cross-section of each column 0 may, if desired, be such that it fits between the half-sections of the main supports F formed as divided-section supports 2 and a connection can then be made between the column 0 and the main support F. Thus, for instance, the cross-section of the column 0 can be any I-section, expediently of wide feet, but it is more advantageous to provide a closed tubular box-girder type of cross-section which can for instance be produced by welding together C- or U-shaped sections with their open faces facing each other.

Figure 2:
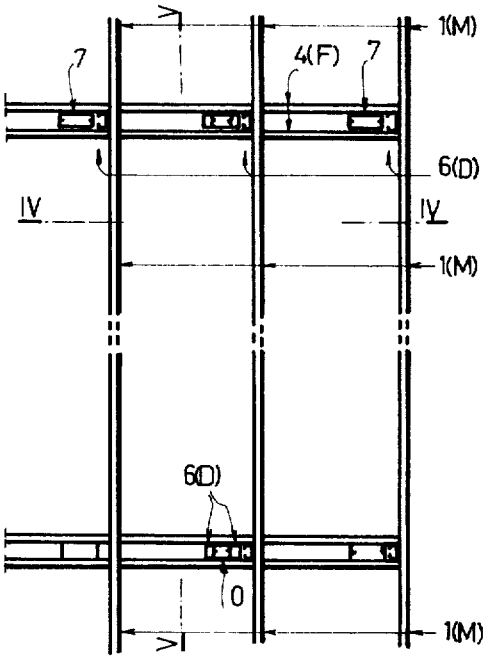
FIG. 2 is a similar plan configuration for main supports of large span.

FIG. 2 shows the ground plan of a structural construction wherein the auxiliary supports M are of small span and therefore the auxiliary supports M are made up of the C-shaped solid supports 1. Therefore in this figure the splice plates for the auxiliary supports are not indicated. On this basis, the span of the supports of the main supports F are of such a magnitude that the divided section supports 2 are insufficient to take them up and instead the latter must be doubled to form divided chord or built-up Vierendeel girders 4. The divided section chords of the main supports F formed as divided chord Vierendeel girders 4 are held together and co-ordinated by splice plates 7 which are themselves expediently formed as closed tubes made up of two C-shaped sections placed open face to open face.

Figure 3:
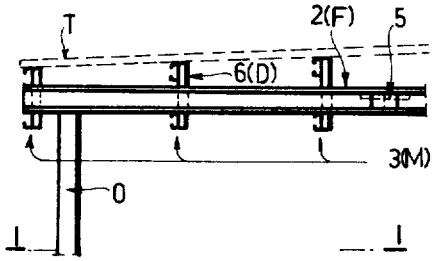
FIG. 3 is a section taken along the plane III—III of FIG. 1.

FIG. 3 shows the schematic cross-section of the light-structure building frame shown in FIG. 1.

The figure shows well that the main supports F are formed as divided-section supports 2 while the auxiliary supports M are formed as single-chord Vierendeel girders 3. The splice plates 6 co-ordinating the chords of the auxiliary supports M increase in height from left to right as seen, and by changing their height in a co-ordinated manner, a sloping roof T can be obtained. In this way the building frame according to the invention need not be of the flat roof type but can also be used as the frame of buildings of slightly sloping roof. It can also be observed in FIG. 3 that the end auxiliary support M at the same time serves as a cornice support extending along the longitudinal edge of the roof of the building. It can also be seen that the head of the column 0 projects between the half-sections of the main supports F formed as built-up supports 2.

Figure 4:
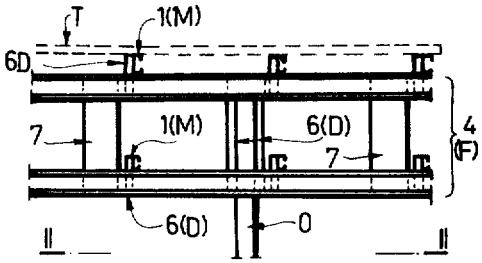
FIG. 4 is a section along the plane IV—IV of FIG. 2.

FIG. 4 shows a part of the cross-section of the building shown in FIG. 2. In this case the supports F are constructed in the form of double chord Vierendeel girders 4. The splices 7 co-ordinating the chords of the double divided chord Vierendeel girders 4 are of closed section made up facing C-sections in the manner shown in FIG. 2. In this case the roof plate T is flat and thus the auxiliary supports M formed as a single chord Vierendeel girder 3 have a constant height dimension. The main supports F and the auxiliary supports M are secured together by means of diaphragms D which are also expediently of C-shaped cross-section.

Figure 5:
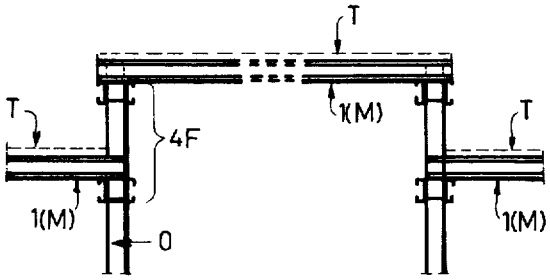
FIG. 5 is a section along the plane V—V of FIG. 2.

FIG. 5 shows that by raising every second column space a hall construction provided with skylights can readily be constructed by the present invention. This figure also shows that the columns 0 project between the built-up chords of the divided chord Vierendeel girders 4.

The heads of the columns 0 not only serve to take load from the main supports F but also fulfil the role of splices, the so-called Vierendeel columns, which coordinate the chords of the main supports F constructed as divided section Vierendeel girders 4. The main supports F and the columns 0 are connected by a bolt connection. The heads of the columns 0 are most expediently constructed from sections of a C-shaped configuration and moreover so that the open part of the C-section should face the body or trunk of the column 0.

The diaphragms D are also capable of fulfilling several roles and expediently are also made from a C-section. In addition to connecting together the main supports F and the auxiliary supports M, the diaphragms D can play a part in creating sloping roofs, in rendering parts of the main supports rigid against bending, and moreover where the auxiliary support M is formed as a single chord Vierendeel girder 3, then the diaphragms D can also replace the splices 6.

Generally speaking, both the auxiliary supports M and the main supports F can be of continuous girder construction and may be provided with internal pivots 5 with the aid of which the individual support sections are capable of independent change of shape, are rendered mutually independent from each other i.e. can be determinate from a statical point view. The possibility also arises of provided either the main supports F or the auxiliary supports M with end overhangs.

The drawings do not show the basic bodies which can be formed in any desired manner and the columns 0 may also be connected to the basic bodies in any desired manner such as pivotally in both principal directions of the ground plan or clamped in both principal directions or pivoted in one direction and clamped in the other direction.

Figure 6:
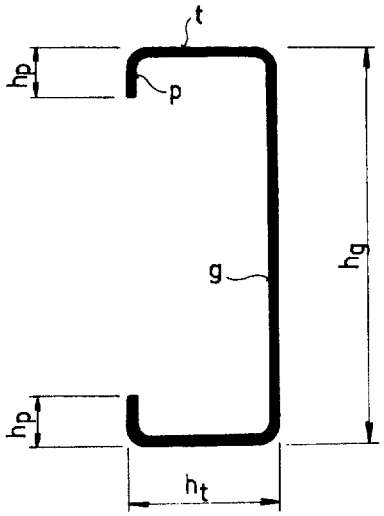
FIG. 6 is a cross-section of the C-shaped section constituting the basic section of the supports of the structural construction.

FIG. 6 shows on a larger scale the basic section of C-shaped cross-section forming the solid support 1. The C-shaped section is made up of three characteristic sections, namely of the web g, the feet t connected thereto and the flanges p forming projections of the feet t. By doubling the C-shaped basic section in a juxtaposed manner, one obtaines the built-up supports 2; by doubling them one below the other, one obtains the single chord Vierendeel girders 3 while by doubling the built-up supports one below the other one obtains a divided chord Vierendeel girder 5. In principle, it may be desirable to make all the horizontal supports forming the beam network of the building from identical C-shaped sections but naturally the possibility also exists of utilising different C-shaped sections e.g. from the point of view of reducing the weight, providing false ceilings etc.

The respective longitudinal dimensions $h_g$, $h_t$, $h_p$ of the web feet and flanges forming part of the C-sections are expediently integral multiples of the micro-module $\bar{m}\bar{m}$ which itself forms an integral fraction, expediently, of the basic module $\bar{m}$ of the structural framework. According to experience, it is expedient to keep predetermined ratios between the web g, feet t and flanges p of the C-profiles. It has proved most advantageous if the section dimensions are such that $h_g:h_t:h_p=8:2:1$. From the point of view of statics and stabilisation, sections have also proved to be advantageous where the relationship is $h_g:h_t:h_p=6:3:1$.

Figure 7:
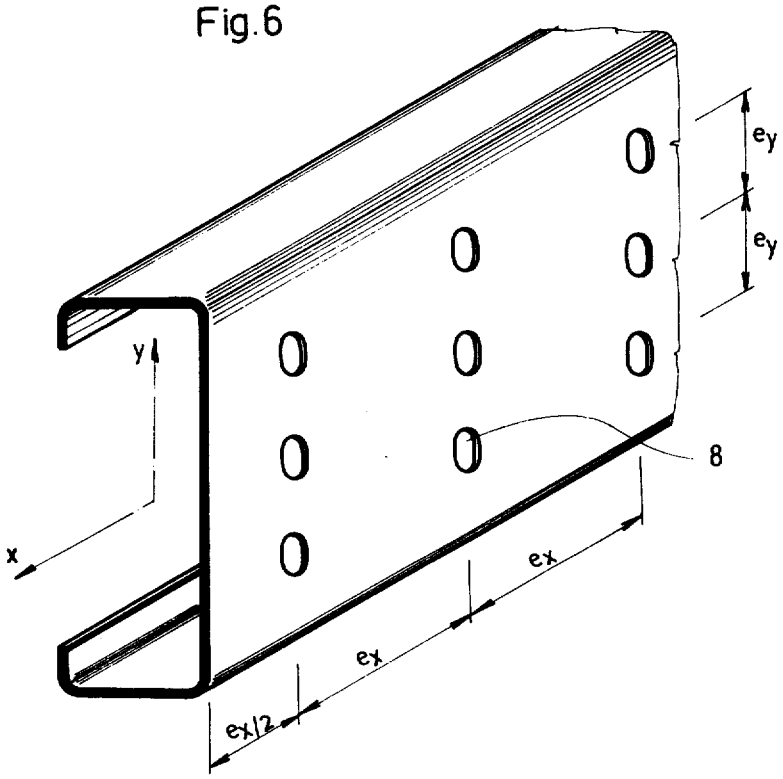
FIG. 7 is a fragmentary perspective view of the C-shaped section indicating the perforations.

It is remarked here that the dimensions of spacing of the structural framework i.e. distances between columns, between the supports, the internal wall spacings between half sections, the distribution of the splices etc. must also be integral multiples of the basic module $\bar{m}$ or the micro-module $\bar{m}\bar{m}$. In contrast, the spacing of the individual holes of the rows 8 of holes of the C-sections, prefabricated in the factory, from each other and from the end of the section are integral multiples of the micro-module $\bar{m}\bar{m}$ derived from the basic module $\bar{m}$. In FIG. 7 it can be seen that the individual holes of the rows of the holes 8 are distributed in this sense both in the longitudinal direction x of the C-profile as well as the direction y at right angles thereto.

According to experience obtained, the minimum hole spacing $e_x$ in the direction x between the holes of the row of holes 8 must be twice the minimum hole spacing $e_y$ in the direction y. The perforations forming the row of holes 8 must be at a distance of at least 1 micro-module $\bar{m}\bar{m}$ from the line of intersection of the outer planes of the feet t and the web g. In addition to perforating the C-profiles forming the horizontal supports it is expedient to perforate the splices 6 and 7 and the C-sections forming the diaphragms D with rows of holes. In this way, the erection on site is genuinely reduced, apart from assembly, to placing the bolts into the holes brought into alignment and to tightening the bolts.

The structural support constituted by the solid supports 1, the divided-section supports 2, the single chord Vierendeel girders 3 and the divided chord Vierendeel girders 4 as well as their supplementary elements can be simple and productively prefabricated at the factory. Most advantageously, the C-shaped profiles can be cold-formed, thin-walled profiles. In connecting the elements in the factory, various welding methods, raw or tensioned bolted joints and optionally also metallic bonding or brazing may be used. The method of connection on site is always bolting. The identical nature of the sections and the uniformity of the connections coupled with the modularity of the system enables a high degree of automation to be effected.

The fact that the C-sections are perforated on the basis of the micro-module $\bar{m}\bar{m}$ developed from the basic module $\bar{m}$ results in simply requiring the beam like supports and their connecting elements to be cut to size and thus the required construction can in practice be "delivered from stock". The complete yet unlimited co-ordination of dimensions also means that the building frame can be fitted into all known systems of building.

I claim as my invention:

1. In a light-weight modular metallic frame for a building having vertical columns including column elements supporting a substantially horizontal assembly of beam elements, the improvement wherein: each beam element is perforated and is channel-shaped in transverse cross-section;

the beam elements form a lattice of mutually parallel main beams and mutually parallel auxiliary beams non-coplanar with and perpendicular to the main beams;

the main beams are spaced apart by a predetermined horizontal distance corresponding to a first modular length;

each main beam comprises two beam elements in a parallel, spaced apart and back-to-back relationship and secured to a vertical column extending in the space between said elements;

the main beams are arranged in vertically spaced-apart parallel pairs to form double Vierendeel girders and;

each auxiliary beam comprises at least one beam element connected to a main beam;

the perforations in all of said beam elements are at a regular spacing which is an integral fraction of said first modular length; and said double Vierendeel girders, said auxiliary beams, and said main and auxiliary beams are connected by channel-shaped perforated, upright elements extending perpendicularly to the main beams, with fastening elements passed through the perforations.

2. A modular frame according to claim 1, wherein the main and auxiliary beams project beyond the columns to form an overhang of the frame beyond the columns.

3. A modular frame according to claim 1, wherein the main beams comprise double Vierendeel girders and the upper portion of the columns comprise some of the first plurality of upright elements.

4. A modular frame according to claim 1, wherein each channel shaped element comprises base, arms and flange portions and wherein the longitudinal dimensions of the base, arm and flange portions in cross-section are integral fractions of the first modular length.

5. A modular frame according to claim 4, wherein the respective longitudinal dimensions of the base, arms and flange portions in cross-section are in the ratio of 8:3:1.

6. A modular frame according to claim 4, wherein the respective longitudinal dimensions of the base, arms and flange portions in cross-section are in the ratio of 6:3:1.

7. A modular frame according to claim 4, wherein the perforations are in rows and columns which are at right angles to each other and are spaced apart a distance equal to an integral fraction of the first modular length.

8. A modular frame according to claim 7, wherein the minimum spacing of the perforations of each row in the direction at right angles to the longitudinal axis of the element is one-half the minimum spacing of the columns of perforation along the longitudinal axis.

9. A modular frame according to claim 1, further comprising clamping members for connecting columns to the main beams in both principal directions.

10. A modular frame according to claim 1, wherein at least one auxiliary beam comprises a single chord Vierendeel girder formed from the solid supports.

11. A modular frame according to claim 1, wherein at least one column comprises a divided chord Vierendeel girder formed from the elements turned with their open faces toward each other.

* * * * *